US007125278B2

(12) United States Patent
Maitani et al.

(10) Patent No.: US 7,125,278 B2
(45) Date of Patent: Oct. 24, 2006

(54) PIERCE JOINT TERMINAL, AND ASSEMBLY OF PIERCE JOINT TERMINAL AND CIRCUIT MEMBER

(75) Inventors: Yukihiro Maitani, Shizuoka (JP); Hideto Kumakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/245,187

(22) Filed: Oct. 7, 2005

(65) Prior Publication Data

US 2006/0079116 A1 Apr. 13, 2006

(30) Foreign Application Priority Data

Oct. 13, 2004 (JP) ..... 2004-298813

(51) Int. Cl.
*H01R 4/24* (2006.01)

(52) U.S. Cl. ..... 439/422; 439/885

(58) Field of Classification Search ..... 439/421–424, 439/885

See application file for complete search history.

(56) References Cited

U.S. PATENT DOCUMENTS

| | | | | | |
|---|---|---|---|---|---|
| 3,845,456 | A | * | 10/1974 | Michaels | 439/422 |
| 4,021,095 | A | * | 5/1977 | Kinkaid et al. | 439/885 |
| 4,082,402 | A | * | 4/1978 | Kinkaid et al. | 439/422 |
| 4,261,629 | A | * | 4/1981 | Reynolds et al. | 439/885 |
| 4,576,426 | A | * | 3/1986 | Herrmann | 439/423 |

FOREIGN PATENT DOCUMENTS

| | | |
|---|---|---|
| JP | 63-13285 | 1/1988 |

* cited by examiner

*Primary Examiner*—Tho D. Ta
(74) *Attorney, Agent, or Firm*—Finnegan, Henderson, Farabow, Garrett & Dunner, L.L.P.

(57) ABSTRACT

A pierce joint terminal includes a base. The terminal includes a contact raised from an outer periphery of the base and configured to pierce a circuit member to be crimped for establishing electric contact with a conductor within the circuit member.

7 Claims, 7 Drawing Sheets

PIERCE JOINT TERMINAL, AND ASSEMBLY OF PIERCE JOINT TERMINAL AND CIRCUIT MEMBER

CROSS-REFERENCE TO RELATED APPLICATIONS

This application is based upon and claims the benefit of priority from Japanese Patent Application No. 2004-298813 filed on Oct. 13, 2004; the entire contents of which are incorporated herein by reference.

BACKGROUND OF THE INVENTION

The invention relates to a pierce joint terminal, and an assembly of a pierce joint terminal and a circuit member. According to the invention, the contact of the pierce joint terminal pierces into the circuit member such as a flat cable to crimp the end of the contact projecting through the circuit member, thus establishing electric contact with a conductive portion within the circuit member.

A related art of the pierce joint terminal is disclosed in, for example, Japanese Patent Application Laid-open No. S63-13285.

A pierce joint terminal has a flat plate-shaped base portion. The base portion has square holes at two portions thereof. Each peripheral edge of the holes constitutes the inner peripheral edge of the base portion. Each inner peripheral edge of the base portion has four connection pawls raised. The four connection pawls are provided to extend from the inner peripheral edge of the base portion and they are respectively bent upwardly.

SUMMARY OF THE INVENTION

In the pierce joint terminal, however, the connection pawls are raised at the inner peripheral edge of the base portion. Therefore, the length dimension of the connection pawl becomes half or less the distance between opposed connection pawls. Accordingly, the connection pawl cannot be pierced into a flat circuit member such as a flat cable deeply.

Specifically, the maximum space between the connection pawls is required to be smaller than the width of a conductive portion, and a conductive portion with a small width easily causes the above problem.

The invention is directed to a pierce joint terminal and an assembly of a pierce joint terminal and a circuit member, which establish excellent electric contact between the contact of the terminal and the circuit member, and facilitates a crimping work of the contact.

The first aspect of the invention provides a pierce joint terminal. The terminal includes a base. The terminal includes a contact raised from an outer periphery of the base and configured to pierce a circuit member to be crimped for establishing electric contact with a conductor within the circuit member.

The piece joint terminal may be connected to an elongate carrier frame using an extension portion extending from the carrier frame. The base is rectangular. The contact may include contacts located on sides of the rectangular base respectively.

The piece joint terminal may be connected to an elongate carrier frame using an extension portion. The base is circular. The contact includes contacts arrayed at an interval on circle of the circular base.

The extension member may include neighboring extension members having ends located differently from each other. The pierce joint terminal includes pierce joint terminal arrayed in a staggered manner along the carrier frame.

The contact may be located at an entire outer periphery of the base.

The second aspect of the invention provides an assembly of a pierce joint terminal and a circuit member. The assembly includes a circuit member including a conductor. The assembly includes a pierce joint terminal. The terminal includes a base. The terminal includes a contact raised from an outer periphery of the base and piercing the circuit member to be crimped for establishing electrical contact with the conductor.

The contact may be located at an entire outer periphery of the base.

BRIEF DESCRIPTION OF THE ACCOMPANYING DRAWINGS

DETAILED DESCRIPTION OF THE PREFERRED EMBODIMENTS

A pierce joint terminal and an assembly of the pierce joint terminal and a circuit member according to embodiments of the invention will be described in detail with reference to the drawings.

First Embodiment

Figure 1:
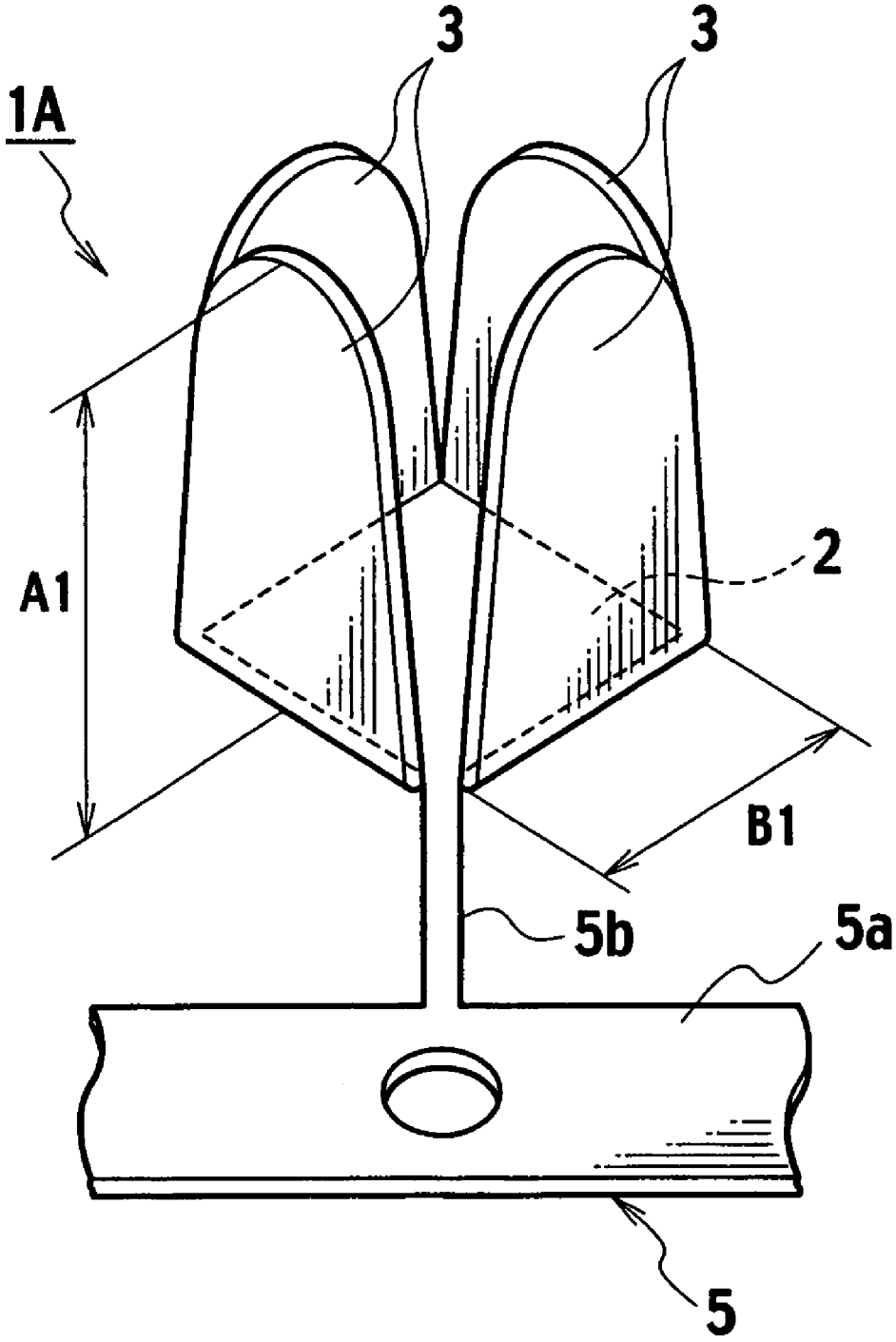
FIG. 1 is a perspective view of a pierce joint terminal according to a first embodiment
Figure 2:
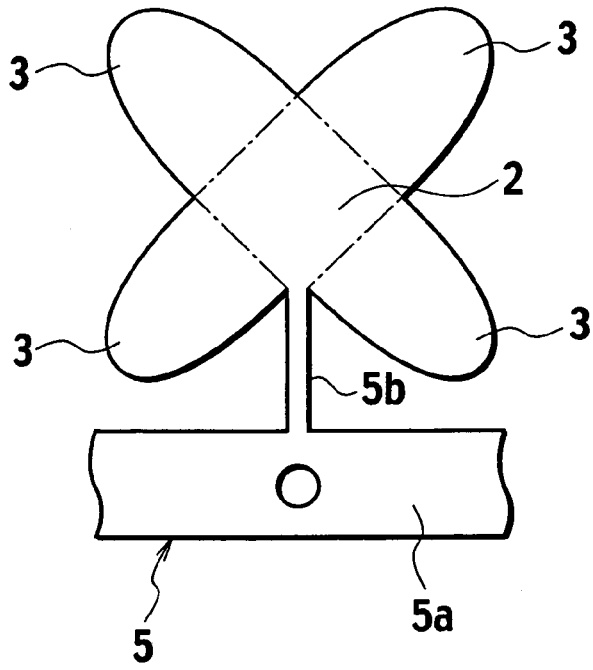
FIG. 2 is a development view of the pierce joint terminal illustrated in FIG. 1.

With reference to FIG. 1, a pierce joint terminal 1A includes a square base portion 2; and four connection pawls 3 as contacts raised from four side edges of the base portion 2. As illustrated in FIG. 2, four connection pawls 3 are integrally provided to extend outwardly over four sides of outer peripheral edges of the base portion 2, namely, over an entire circumference, and they are respectively bent upwardly.

The pierce joint terminals 1A are connected to each other using a carrier 5. The carrier 5 includes an elongate belt-shaped carrier frame 5*a*. The carrier 5 includes extension portions 5*b* extended from the one-side edge of the carrier frame 5*a* at equal intervals and in a direction orthogonal to the carrier frame 5*a*. The distal end of each extension portion 5*b* is connected to the base portion 2 of the pierce joint terminal 1A. The connecting portion of the square base portion 2 and the extension portion 5*b* is a corner of a square. The orientation of the connection pawl 3 is set at an inclined angle of 45° to a direction in which the carrier frame 5*a* extends. The pierce joint terminals coupled by the carrier 5 in this manner are cut at the proper portion of the carrier 5 if required. The cut piece is used as a single pierce joint terminal 1A, or pierce joint terminals 2A coupled by the carrier 5.

Figure 3:
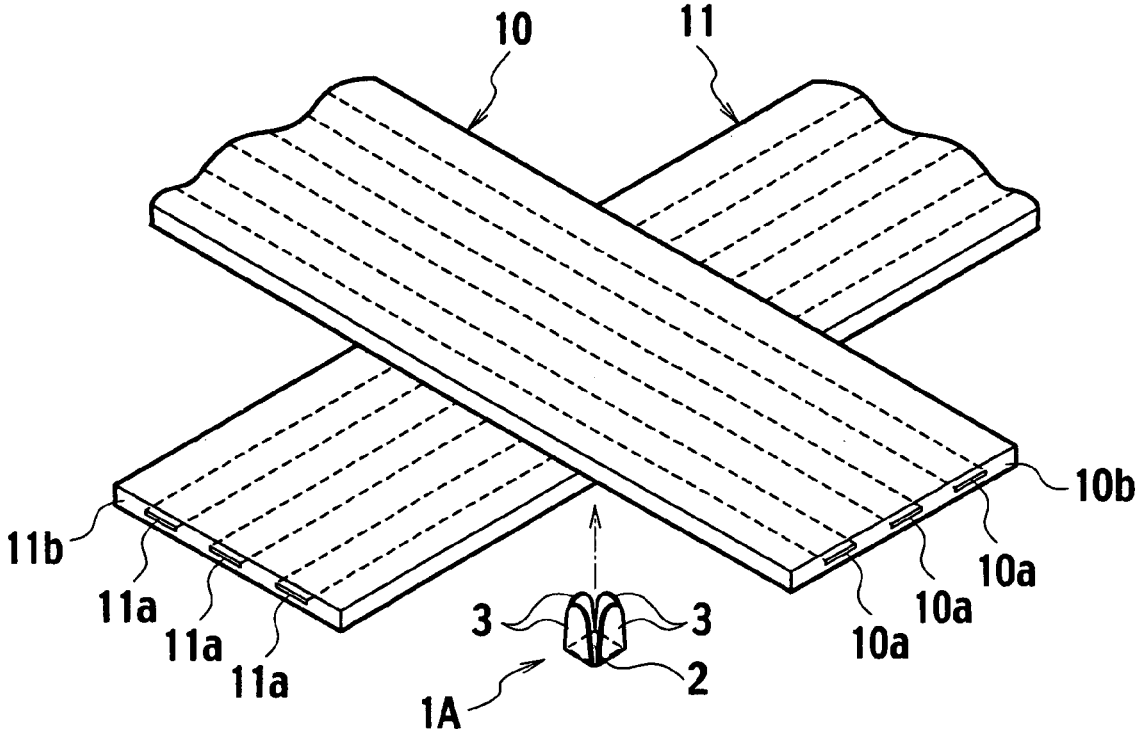
FIG. 3 is a perspective view of the pierce joint terminal illustrated in FIG. 1 and flat cables to be fitted with the pierce joint terminal.

Next, the assembly of the pierce joint terminal 1A and a flat cable will be described. As illustrated in FIG. 3, in the assembly, two flat cables 10, 11 which are flat circuit members each include, for example, three conductive potions 10*a*, 11*a* arranged to be spaced from one another in parallel with one another. The assembly includes insulating outer coats 10*b*, 11*b* covering the conductive portions 10*a*, 11*a*. The two flat cables 10, 11 are arranged in directions orthogonal to each other and they cross at one position. The conductive portions 10*a*, 11*a* of both the flat cables 10, 11 also cross each other at the crossing portion.

The carrier 5 is completely cut off to prepare a single pierce joint terminal 1A. The single pierce joint terminal 1A is pierced to a desired position where the conductive portions 10*a*, 11*a* cross each other.

Figure 4A:
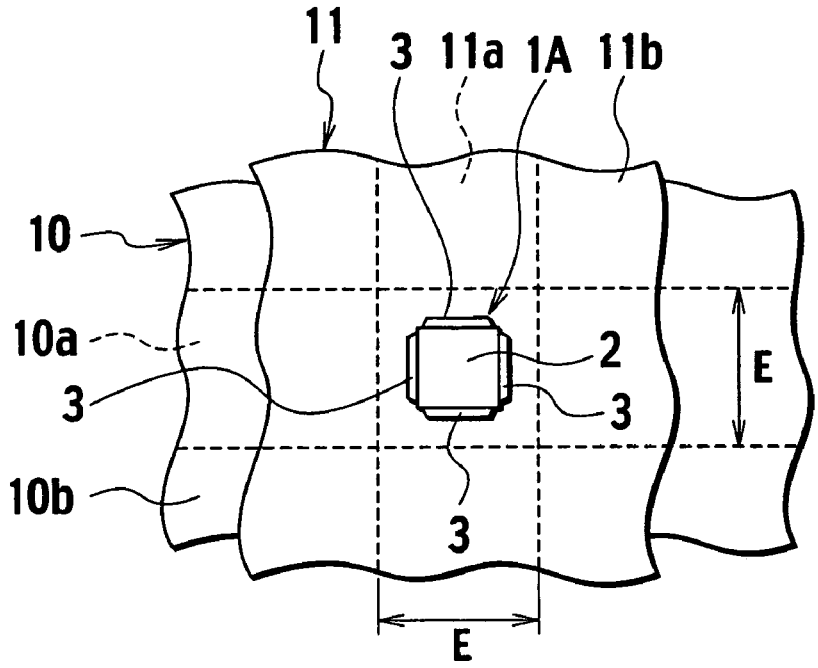
FIG. 4A is a plan view of the assembly of the pierce joint terminal and the flat cables illustrated in FIG. 3.
Figure 4B:
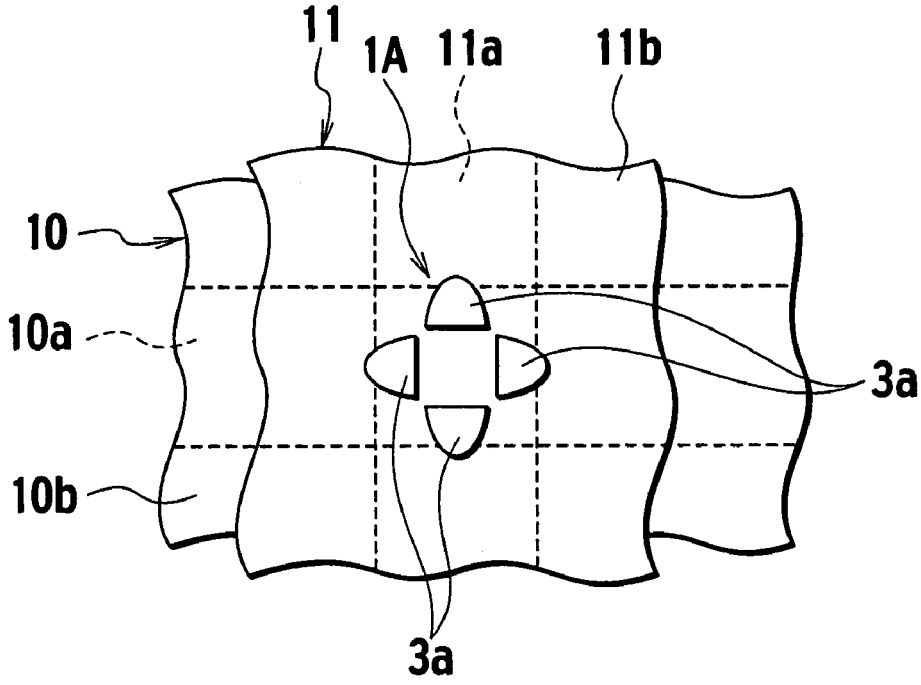
FIG. 4B is a bottom view of the assembly of the pierce joint terminal and the flat cables illustrated in FIG. 3.

Next, as illustrated in FIGS. 4A and 4B, a crimping work is performed on each distal end 3*a* of the connection pawls 3 that have pierced the two flat cables 10, 11. The connection pawls 3 which have pierced the respective conductive portions 10*a*, 11*a* of two flat cables 10, 11 bring the respective conductive portions 10*a*, 11*a* in contact with each other by the crimping work. Thereby, desired conductive portions 10*a*, 11*a* of the flat cables 10, 11 are electrically connected to each other using the pierce joint terminal 1A.

As described above, in the pierce joint terminal 1A, four connection pawls 3 densely pierce the conductive portions 10*a*, 11*a* of the flat cables 10, 11. This structure achieves a large contacting area and an excellent electric contacting condition. In the pierce joint terminal 1A, the length A1 of the connection pawl 3 is elongated to a certain extent without depending on a distance B1 between opposed connection pawls 3. Therefore, the connection pawls 3 are pierced into two flat cables 10, 11 deeply, and a crimping work of the connection pawls 3 is performed easily without failure. Furthermore, arbitrary setting of the spacing B1 between opposed connection pawls 3 allows for fabrication of a pierce joint terminal which can be applied even if the width E of the conductive portions 10*a*, 11*a* of the flat cables 10, 11 is narrowed.

According to the first embodiment, the base portion 2 is square and the connection pawls 3 are four connection pawls 3 raised at respective sides of the square. Thereby, the four connection pawls 3 come in contact with the conductive portions 10*a*, 11*a*, and this structure ensures sufficiently large contacting area, thus reliably achieving excellent electrical contacting condition.

Figure 5A:
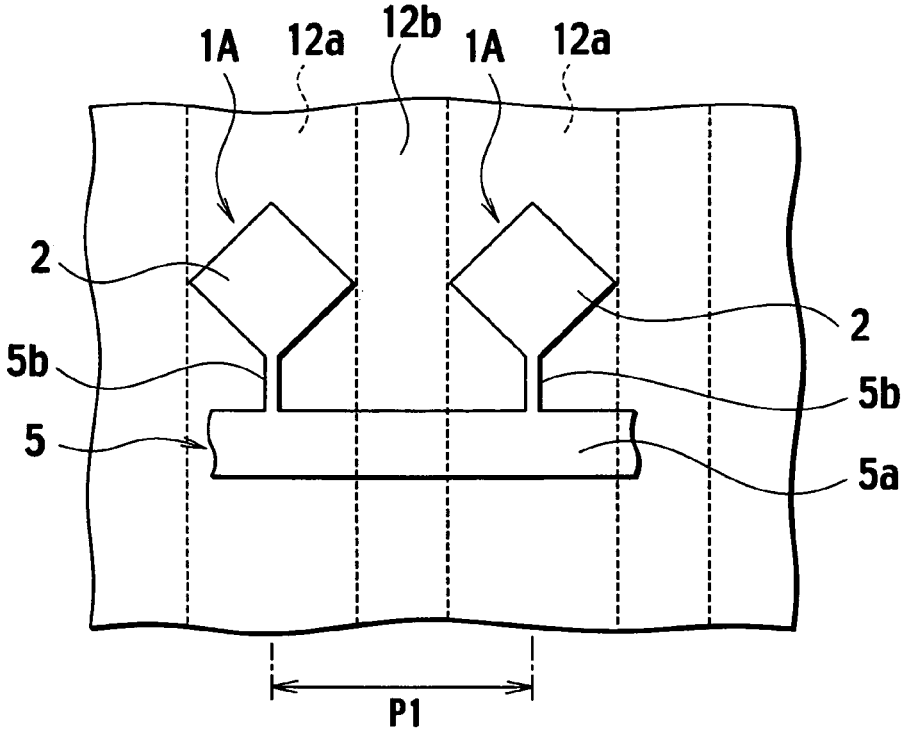
FIG. 5A is a plan view of the assembly of a pierce joint terminal and a flat cable according to another embodiment.
Figure 5B:
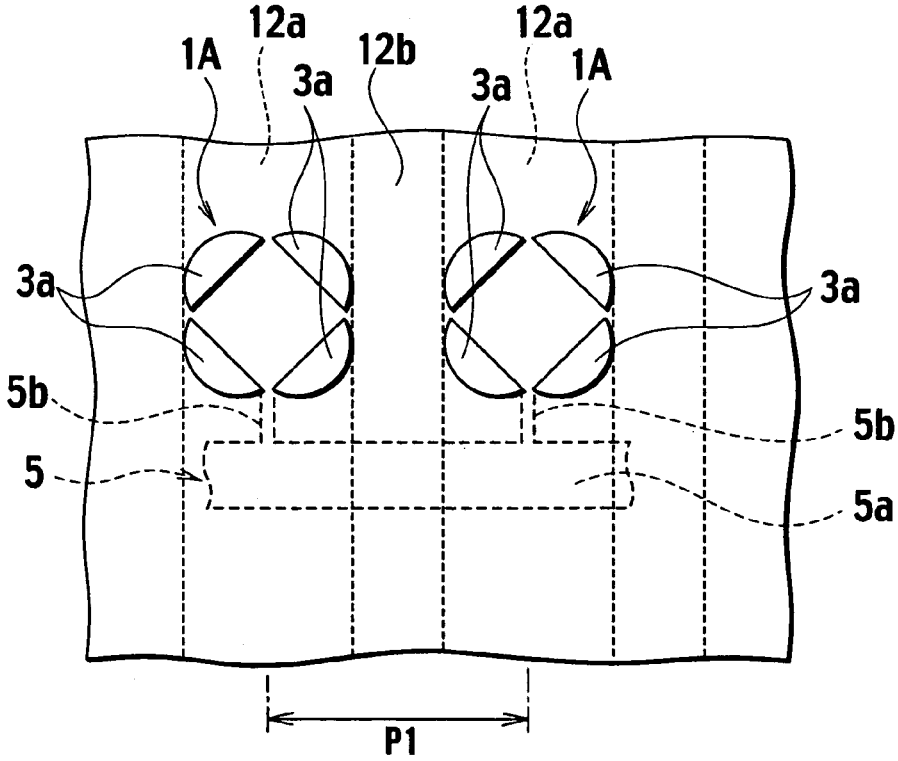
FIG. 5B is a bottom view of the assembly of the pierce joint terminal and the flat cable illustrated in FIG. 5A.

Next, another assembly of the pierce joint terminal 1A and a flat cable will be described. As illustrated in FIGS. 5A, 5B, a flat cable 12 as a flat circuit member includes conductive portions 12*a* arranged to be spaced from each other in parallel to one another. The flat cable 12 includes an insulating outer coat 12*b* covering the outer peripheries of these conductive portions 12*a*.

A carrier 5 is cut at the proper portion such that the number and the arrangement of the pierce joint terminals 1A correspond to the number and the arrangement of conductive portions 12*a* to be electrically conducted within the flat cable 12. Pierce joint terminals 1A coupled by the carrier 5 are prepared by the cutting.

Next, the pierce joint terminals 1A coupled at the carrier 5 are pierced at the location where desired conductive portions 12*a* cross each other. Next, as illustrated in FIG. 5B, the distal ends 3*a* of the respective connection pawls 3 which have pierced one flat cable 12 are respectively crimped so that this work is completed. Desired conductive portions 12*a* of the flat cable 12 are electrically connected using the pierce joint terminals 1A coupled.

Figure 6:
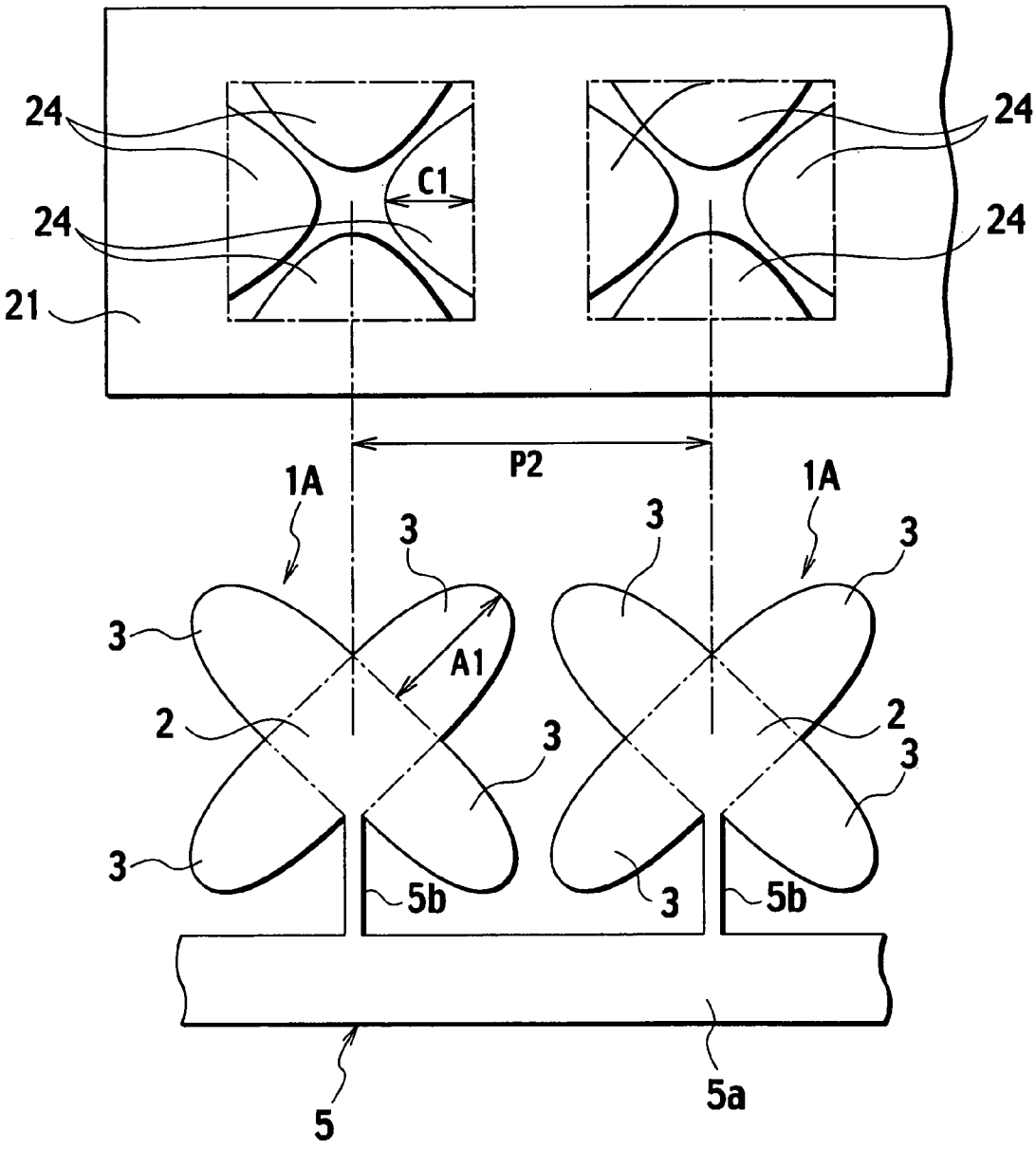
FIG. 6 is a view for comparing lengths of extension portions for pawl (connection pawls) of a comparative example and the first embodiment, when the extension portions are fabricated with the identical terminal pitch.

When neighboring conductive portions 12*a* within the flat cable 12 are connected to each other, the pitch P1 between the conductive portions 12*a* (illustrated in FIGS. 5A, 5B) is small. The pitch P2 between the pierce joint terminals 1A is formed to correspond to the pitch P1. In this case, lengths C1, A1 of the connection pawls 24, 3 of a comparative example (a conventional pierce joint terminal) and the first embodiment are compared with each other. As illustrated in FIG. 6, in the comparative example, the length C1 of the connection pawl 24 is less than ½ the pitch P2 at most. On the other hand, in the first embodiment, the orientations of the connection pawls 3 are set at an inclined angle of 45° to a direction in which the carrier frame 5*a* extends. Thereby, the length A1 of the connection pawl 3 is formed to be sufficiently longer than that of the comparative example. Accordingly, even if the pitch P2 between the terminals is small, the distal ends of the connection pawls 3 are securely crimped. The length A1 of the connection pawl 3 is set to be the maximum when the setting is conducted at an angle of 45° to the direction in which the carrier frame 5*a* extends.

Figure 7:
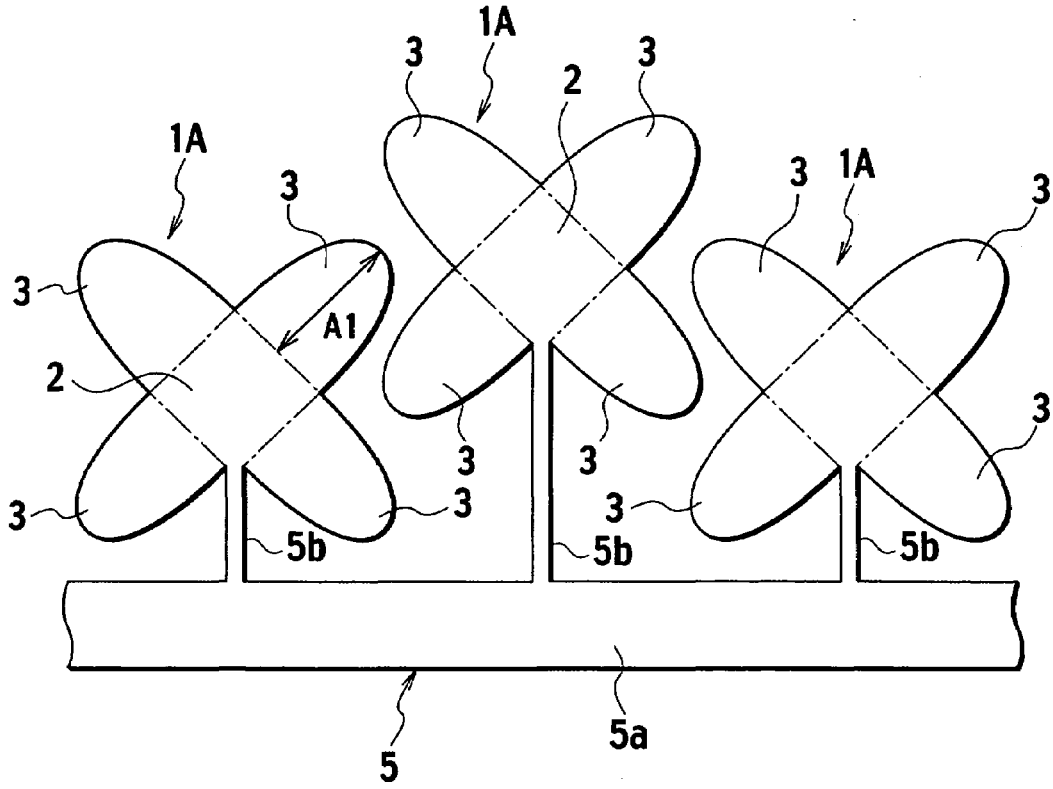
FIG. 7 is a development view showing a modification of the coupling structure of the pierce joint terminal illustrated in FIG. 1.

A modification of the first embodiment will be described next. As illustrated in FIG. 7, extension portions 5*b* provided to extend from a carrier frame 5 and spaced from one another includes longer ones and shorter ones alternately arranged. The longer extension portions 5*b* extend over the shorter extension portions 5*b*. Thereby, piecing joint terminals 1A connected to the distal ends of respective extension portions 5*b* are arrayed in a staggered manner. The remaining constitutions of the modification are the same as those of the first embodiment, they are designated with same reference numerals, and explanation thereof is omitted.

The modification ensures a sufficient space used for forming connection pawls 3 of each pierce joint terminal 1A. This structure obtains such an advantage that the connection pawl 3 of the pierce joint terminal 1A is formed to be sufficiently elongate.

In the modification, the pierce joint terminals 1A are arrayed in a staggered manner by providing the extension portions 5*b* on the identical side edge of the carrier frame 5*a* and setting the extension portions to longer ones and shorter ones. On the other hand, such a constitution may be adopted that extension portions are provided on different left and right side edges of the carrier portion 5*a* to array pierce joint terminals 1A in a staggered manner.

Second Embodiment

Figure 8:
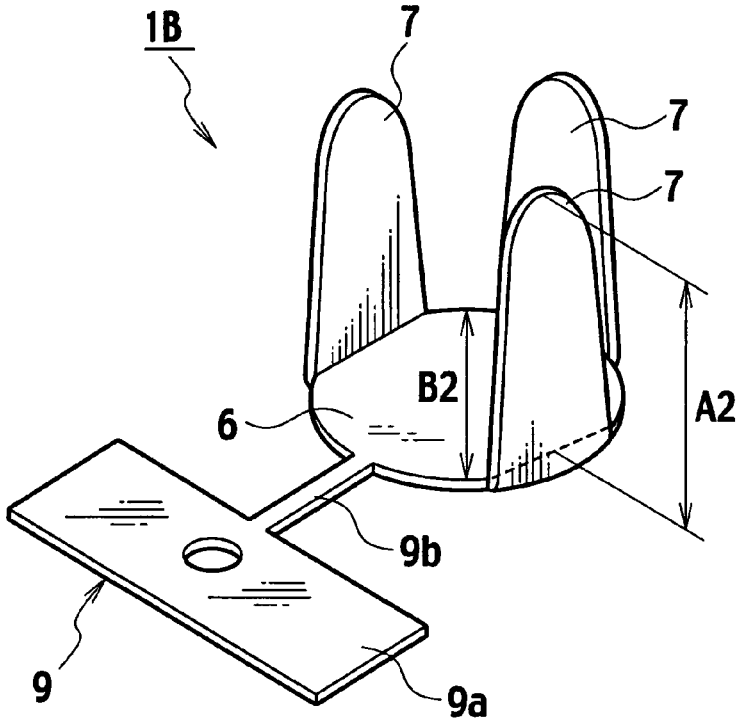
FIG. 8 is a perspective view of a pierce joint terminal according to a second embodiment.
Figure 9:
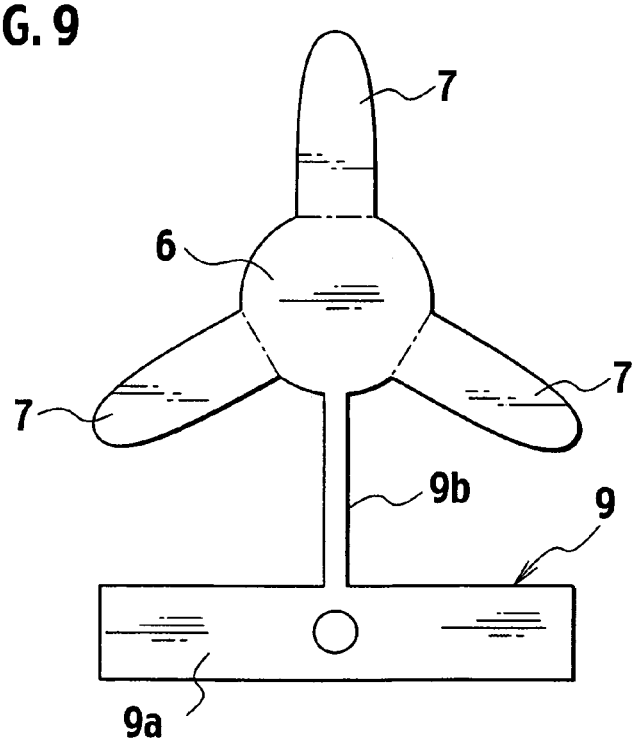
FIG. 9 is a development view of the pierce joint terminal illustrated in FIG. 8.

With reference to FIG. 8, a pierce joint terminal 1B includes a circular base portion 6, and three connection pawls 7 raises from the outer peripheral edge of the base portion 6. Three connection pawls 7 are provided to integrally extend outwardly at equally spaced positions of the outer circular peripheral edge of the base portion 6, that is, over an entire circumference thereof, and they are respectively bent to rise.

Pierce joint terminals 1B are coupled using a carrier 9 like the first embodiment. The carrier 9 includes a carrier frame 9*a* as a straight line. The carrier 9 includes extension portions 9*b* extended from the one-side edge of the carrier frame 9*a* at equal intervals and in a direction orthogonal to the carrier frame 9*a*. Each distal end of the extension portion 9*b* is connected to the base portion 6 of the pierce joint terminal 1B. The connecting portion of the circular base portion 6 and the extension portion 9*b* is one end of the circle. The orientation of the connection pawl 7 is set at an inclined angle of 60° to a direction in which the carrier frame 9*a* extends. The pierce joint terminals 1B thus coupled by the carrier 9 are cut off at a proper portion thereof if required. The cut piece is used as a single pierce joint terminal 1B, or pierce joint terminals 1B coupled by the carrier 9.

In the pierce joint terminal 1B, three connection pawls. 7 densely pierce the conductive portions 10*a*, 11*a* of a flat circuit member (not illustrated). This structure achieves an excellent electric contacting condition with a large contacting area. In the pierce joint terminal 1B, a length A2 of the connection pawl 7 is elongated to a certain extent without depending on a distance B2 between opposed connection pawls 7. Therefore, the connection pawls 3 are pierced into two flat cables 10, 11 deeply, and a crimping work of the connection pawls 3 is performed easily without failure. The connection pawl 7 is deeply pierced into the flat circuit member (see FIG. 3) and the crimping work of the connection pawl 7 is performed without failure. Furthermore, arbitrary setting of the distance B between opposed connection pawls 7 allows for fabrication of a pierce joint terminal 1B. which can be applied even if the width of a conductive portion in a flat circuit member is narrowed.

According to the second embodiment, the base portion 6 is circular, and the connection pawls 7 are three connection pawls 7 arranged at equal intervals on the circular periphery of the base portion. Thereby, three connection pawls 7 pierce a flat circuit member, and a slightly small area where the connection pawls pierce the flat circuit member, maintains a tensile strength of the flat circuit member itself.

The pierce joint terminal 1B is also applied to the assemblies. illustrated in FIGS. 3, 4A, 4B, 5A, and 5B, and achieves operations and advantages similar to those described in the first embodiment. By adopting the coupling structure illustrated in FIG. 7 for the pierce joint terminal 1B, as explained regarding the modification of the first embodiment, the connection pawl 7 of the pierce joint terminal 1B is formed to be sufficiently elongate.

While the assembly according to the first embodiment has been explained regarding two flat circuit members or one flat cable 10, 11, 12, the invention may be also applied to three or more flat cables, and to a flat circuit member other than the flat cable.

In the first and the second embodiments, when the base portions 2, 6 are rectangular (square) and circular have been described, however, the base portion may also take another shape. While four and three connection pawls 3, 7 have been described, respectively, the number of connection pawls may be 5 or more.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

According to the invention, the contact densely pierces the conductor of the circuit member, thus achieving excellent electric contact with a larger contact area. The contacts rise from the outer periphery of the base, thus being allowed to arbitrarily set in the length dimension, without depending on spacing between opposed contacts. Thus, the contacts are allowed to deeply pierce the circuit member, thus facilitating crimping operation of the contacts. Arbitrary setting of the opposed contacts in the spacing therebetween allows for fabrication of the pierce joint terminal to be adapted for a circuit member having a conductor with a narrowed width.

When neighboring conductors of the circuit member connect to each other, the conductors have a smaller pitch therebetween. In case of forming a pitch between pierce joint terminals in coincidence with the pitch between the conductors, each contact of the pierce joint terminals is set to incline relative to the extension direction of the carrier frame, thus forming elongate contacts. The contacts and the conductors contact with each other to allow for sufficiently enlarged contact area therebetween, thus ensuring excellent electric contact therebetween.

The contacts pierce the circuit member, and the pierced area through the circuit member is slightly smaller, thus maintaining longitudinal tensile strength of the circuit member.

The pierce joint terminals sufficiently ensure spaces for forming contacts of each pierce joint terminals, thus allowing for formation of sufficiently elongate contacts of the pierce joint terminals.

What is claimed is:

1. A pierce joint terminal comprising:

a base; and a contact raised from an outer periphery of the base and configured to pierce a circuit member to be crimped for establishing electric contact with a conductor within the circuit member, wherein the pierce joint terminal is connected to an elongate carrier frame using an extension portion extending from the carrier frame, and the longitudinal direction of the contact is oblique to the longitudinal direction of the carrier frame.

2. The pierce joint terminal according to claim 1, wherein the base is circular, wherein the contact comprises contacts arrayed at an interval on circle of the circular base.

3. The pierce joint terminal according to claim 1, wherein the contact is located at an entire outer periphery of the base.

4. The pierce joint terminal according to claim 1, wherein the base is rectangular, wherein the contact comprises contacts located on sides of the rectangular base respectively.

5. The joint terminal according to claim 4, wherein the extension member comprises neighboring extension members having ends located differently from each other, wherein the pierce joint terminal is arrayed in a staggered manner along the carrier frame.

6. An assembly of a pierce joint terminal and a circuit member comprising:

a circuit member including a conductor; and a pierce joint terminal comprising:

a base; and a contact raised from an outer periphery of the base and piercing the circuit member to be crimped for establishing electric contact with the conductor, wherein the piece joint terminal is connected to an elongate carrier frame using an extension portion extending from the carrier frame, and the longitudinal direction of the contact is oblique to the longitudinal direction of the carrier frame.

7. The pierce joint terminal according to claim 6, wherein the contact is located at an entire outer periphery of the base.

* * * * *